US009229377B2

(12) United States Patent
Shiraki

(10) Patent No.: US 9,229,377 B2
(45) Date of Patent: Jan. 5, 2016

(54) IMAGE FORMING APPARATUS

(71) Applicant: Masatoshi Shiraki, Nagoya (JP)

(72) Inventor: Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 114 days.

(21) Appl. No.: 14/038,903

(22) Filed: Sep. 27, 2013

(65) Prior Publication Data

US 2014/0093259 A1 Apr. 3, 2014

(30) Foreign Application Priority Data

Sep. 28, 2012 (JP) ..... 2012-218496

(51) Int. Cl.
*G03G 21/00* (2006.01)
*G03G 15/16* (2006.01)
*G03G 15/00* (2006.01)

(52) U.S. Cl.
CPC ..... *G03G 15/1675* (2013.01); *G03G 15/5029* (2013.01); *G03G 21/0023* (2013.01); *G03G 21/0058* (2013.01)

(58) Field of Classification Search
CPC ..... G03G 21/0023; G03G 21/0058; G03G 2221/0073; G03G 15/5029
See application file for complete search history.

(56) References Cited

U.S. PATENT DOCUMENTS 4,912,515 A * 3/1990 Amemiya et al. ..... 399/44
5,077,566 A * 12/1991 Ochiai et al. ..... 347/55
5,761,568 A * 6/1998 Haragakiuchi et al. ..... 399/44
6,111,594 A * 8/2000 Jeong ..... 347/140
7,720,399 B2 * 5/2010 Takahashi ..... 399/44
8,059,979 B2 * 11/2011 Deguchi et al. ..... 399/66
8,180,239 B2 5/2012 Furukawa et al.
2006/0029410 A1 * 2/2006 Deguchi ..... 399/66
2007/0071525 A1 * 3/2007 Yoshino et al. ..... 399/346
2010/0067925 A1 * 3/2010 Mori ..... 399/15
2010/0129105 A1 5/2010 Furukawa et al.
2011/0255889 A1 * 10/2011 Ogiso et al. ..... 399/44
2011/0293306 A1 * 12/2011 Matsumoto ..... 399/66
2012/0251139 A1 * 10/2012 Handa ..... 399/44
2013/0058666 A1 * 3/2013 Takahashi ..... 399/38
2015/0117882 A1 * 4/2015 Wakamatsu ..... G03G 15/065 399/44

FOREIGN PATENT DOCUMENTS

JP H04-029283 A 1/1992
JP H04-214586 A 8/1992
JP H04-251882 A 9/1992
JP 2006-259305 A 9/2006
JP 2010-128054 A 6/2010

* cited by examiner

*Primary Examiner* — David Gray
*Assistant Examiner* — Carla Therrien
(74) *Attorney, Agent, or Firm* — Banner & Witcoff, Ltd.

(57) ABSTRACT

An image forming apparatus includes an image carrier, a transfer member and a cleaning member. The image forming apparatus: determines whether the electric resistance of a recording medium is low or high; applies a first transfer bias to the transfer member if the electric resistance is low; applies a second transfer bias to the transfer member if the electric resistance is high; applies a first cleaning bias to the cleaning member if the electric resistance is low; and applies a second cleaning bias to the cleaning member so that a potential difference between a portion of a surface of the image carrier against which the cleaning member is rubbed and the cleaning member becomes smaller than that in a case of applying the first cleaning bias if the electric resistance is high.

23 Claims, 4 Drawing Sheets

IMAGE FORMING APPARATUS

CROSS-REFERENCE TO RELATED APPLICATION

This application is based upon and claims the benefit of priority of Japanese Patent Application No. 2012-218496 filed on Sep. 28, 2012, the contents of which are incorporated herein by reference in its entirety.

BACKGROUND

The present disclosure relates to an electrophotographical image forming apparatus.

As an electrophotographical image forming apparatus, there is known a printer which includes photosensitive elements for carrying developer images, and transfer members for transferring the developer images formed on the photosensitive elements onto a paper sheet.

For example, there has been proposed a color printer which includes four photosensitive drums that are provided corresponding to colors of black, yellow, magenta, and cyan, respectively, a conveyor belt that conveys paper sheets so that the paper sheets come into contact with all photosensitive drums, and four transfer rollers that are provided corresponding to the four photosensitive drums, respectively, so that the conveyor belt is interposed between the transfer rollers and corresponding photosensitive drums.

In this color printer, a resistance value between the most upstream photosensitive drum and a transfer roller facing the corresponding photosensitive drum is measured, and a target value for an electric current to flow between the photosensitive drum and the transfer roller (a transfer current target value) is set based on a resistance value before a paper sheet is conveyed and a resistance value when a paper sheet is being conveyed.

Then, a voltage to be applied between the photosensitive drum and the transfer roller is controlled such that the electric charge to flow between the photosensitive drum and the transfer roller approximates to the transfer current target value.

SUMMARY

However, in cases where the resistance value of a paper sheet is large, such as a case where the humidity of the surroundings is low, the absolute value of the voltage to be applied between the photosensitive drum and the transfer roller is increased in order to approximate the electric current to flow between the photosensitive drum and the transfer roller to the transfer current target value.

In this case, due to the electric current flowing between the photosensitive drum and the transfer roller, the charged state of developer may change between the photosensitive drum and the transfer roller. Specifically, positively charged developer may change to a rarely charged state (uncharged state) or a negatively charged state.

If the developer having changed in the charged state remains on the surface of the photosensitive drum, it becomes difficult to electrostatically clean the surface of the photosensitive drum.

Therefore, an object of an aspect of the present disclosure is to provide an image forming apparatus capable of reliably removing substances attached to an image carrier by a cleaning member.

The aspect of the present disclosure provides the following arrangements:

An image forming apparatus comprising:

an image carrier configured to carry a developer image;

a transfer member configured to face the image carrier and transfer the developer image from the image carrier onto a recording medium;

a cleaning member configured to rub against the image carrier, and clean the image carrier of substances after the developer image is transferred onto the recording medium;

a control device configured to:

determine whether the electric resistance of the recording medium is comparatively low or high;

apply a first transfer bias to the transfer member when it is determined that the electric resistance of the recording medium is comparatively low;

apply a second transfer bias having the same polarity as that of the first transfer bias and having an absolute value larger than that of the first transfer bias, to the transfer member when it is determined that the electric resistance of the recording medium is comparatively high;

apply a first cleaning bias to the cleaning member when it is determined that the electric resistance of the recording medium is comparatively low; and apply a second cleaning bias to the cleaning member so that a potential difference between a portion of a surface of the image carrier against which the cleaning member rubs and the cleaning member becomes smaller than that in a case of applying the first cleaning bias to the cleaning member when it is determined that the electric resistance of the recording medium is comparatively high.

An image forming apparatus comprising:

an image carrier configured to carry a developer image;

a transfer member configured to face the image carrier and transfer the developer image from the image carrier onto a recording medium;

a cleaning member configured to be rubbed against the image carrier, and clean substances attached to the image carrier after the developer image is transferred onto the recording medium;

a humidity sensor configured to measure relative humidity;

a control device configured to:

apply a first transfer bias to the transfer member when the relative humidity measured by the humidity sensor is higher than predetermined relative humidity;

apply a second transfer bias having the same polarity as that of the first transfer bias and having an absolute value larger than that of the first transfer bias, to the transfer member the relative humidity measured by the humidity sensor is equal to the predetermined relative humidity or less;

apply a first cleaning bias to the cleaning member the relative humidity measured by the humidity sensor is higher than the predetermined relative humidity; and apply a second cleaning bias to the cleaning member so that a potential difference between a portion of a surface of the image carrier against which the cleaning member is rubbed and the cleaning member becomes smaller than that in a case of applying the first cleaning bias the relative humidity measured by the humidity sensor is equal to the predetermined relative humidity or less.

DESCRIPTION OF EXEMPLARY EMBODIMENTS

1. Overall Configuration of Printer

Figure 1:
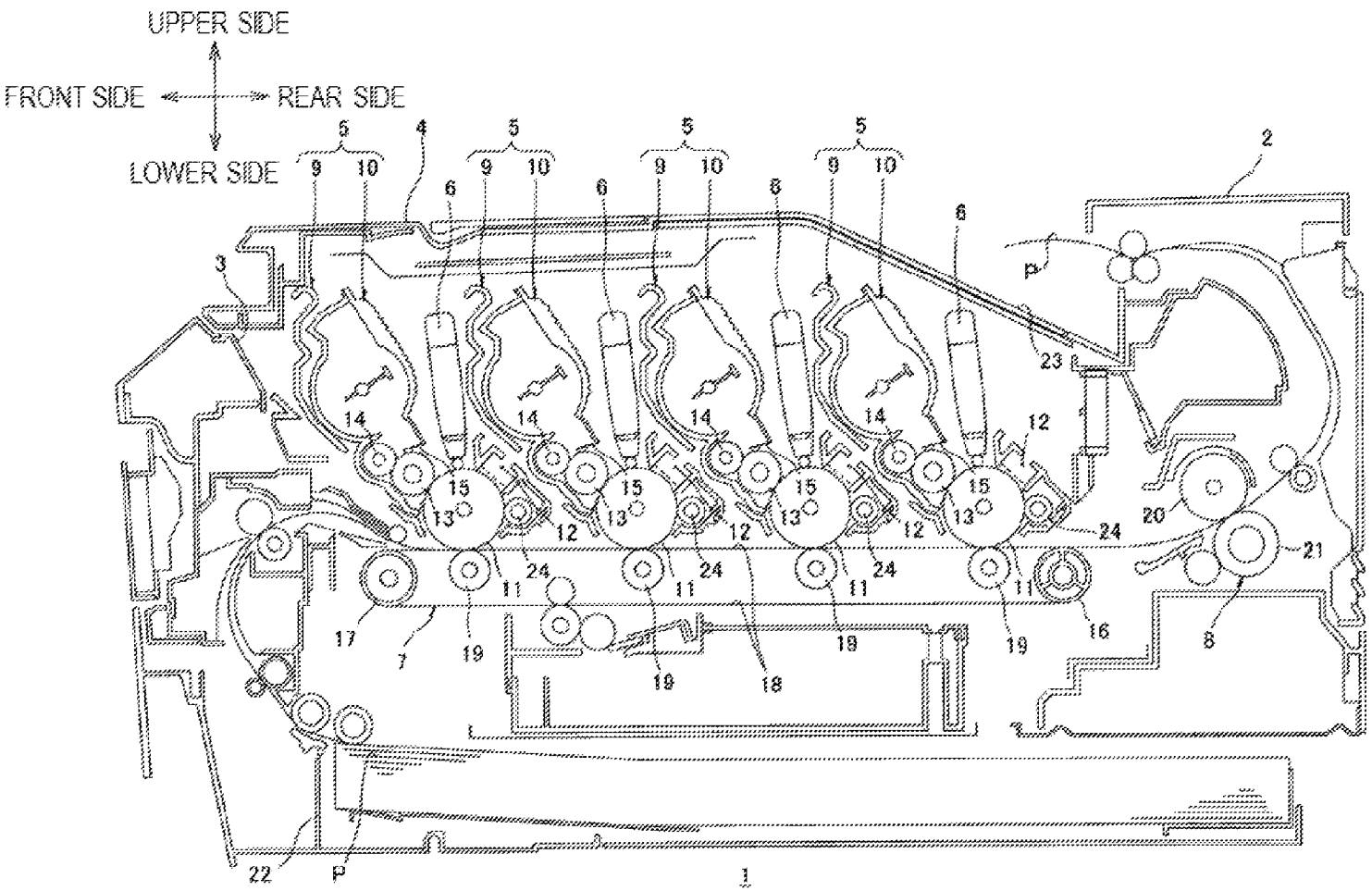
FIG. 1 is a sectional side view illustrating a printer as an image forming apparatus according to an exemplary embodiment.

As shown in FIG. 1, a printer 1 which is an example of an image forming apparatus is a tandem type direct color printer which is horizontally installed.

In the following description, when directions of the printer 1 are stated, the upper side and lower side of the printer refer to a state where the printer 1 is horizontally installed. That is, the upper side of the drawing sheet of FIG. 1 is referred to as the upper side of the printer 1 (one side in a vertical direction (a first direction)) and the lower side of the drawing sheet of FIG. 1 is referred to as the lower side of the printer 1 (the other side in the vertical direction). Further, the left side of the drawing sheet of FIG. 1 is referred to as the front side of the printer 1 (one side in a front-rear direction (a second direction)), and the right side of the drawing sheet of FIG. 1 is referred to as the rear side of the printer 1 (the other side in the front-rear direction). Furthermore, the left side and right side of the printer 1 refer to the state of the printer as seen from the front side. That is, a direction toward a viewer of FIG. 1 is referred to as the right side of the printer (one side in a left-right direction (a third direction)), and a direction away from the viewer of FIG. 1 is referred to as the left side of the printer (the other side in the left-right direction).

The printer 1 includes a main body casing 2 having substantially a box shape. At an upper end portion of the main body casing 2, a top cover 4 for opening and closing a main body opening 3 is provided to be able to swing on a rear end portion of the front cover. The printer 1 includes a plurality of (four) process cartridges 5, a plurality of (four) LED units 6, a transfer unit 7, and a fixing unit 8 which is an example of a fixing device.

All process cartridges 5 are removably installed in parallel at intervals inside the main body casing 2. The plurality of (four) process cartridges 5 correspond to a plurality of (four) colors (black, yellow, magenta, and cyan), respectively.

Each process cartridge 5 includes a drum cartridge 9, and a developing cartridge 10 that is removably mounted on the drum cartridge 9.

The drum cartridge 9 includes a photosensitive drum 11 which is an example of an image carrier, a scorotron charger 12, and a drum cleaning roller 24 which is an example of a cleaning member.

The photosensitive drum 11 is formed in a substantially cylindrical shape long in a left-right direction (longitudinal direction), and is rotatably provided at the rear end portion of the drum cartridge 9.

The scorotron charger 12 is disposed to face the upper rear side of the photosensitive drum 11.

The drum cleaning roller 24 is disposed below the scorotron charger 12 behind the photosensitive drum 11. The drum cleaning roller 24 comes into contact with the photosensitive drum 11 from the rear side. The drum cleaning roller 24 is formed substantially in a columnar shape extending in the left-right direction.

The developing cartridge 10 includes a developing roller 13, and a feeding roller 14 for feeding toner to the developing roller 13.

The developing roller 13 is supported at a lower end portion of the developing cartridge 10 such that it is rotatable and is exposed to the rear side. The developing roller 13 comes into contact with the photosensitive drum 11 from the upper front side. The developing roller 13 is formed substantially in a columnar shape extending in the left-right direction.

The feeding roller 14 is rotatably supported at the upper front side of the developing roller 13 such that the feeding roller is in contact with the developing roller 13. The feeding roller 14 is formed substantially in a columnar shape extending in the left-right direction.

The developing cartridge 10 includes a layer-thickness regulating blade 15 for regulating the thickness of toner fed on the developing roller 13. Further, in a portion of the developing cartridge 10 on the developing roller 13 and the feeding roller 14, toner is stored as an example of developer.

The plurality of LED units 6 is supported on the top cover 4 so as to face the tops of the photosensitive drums 11 of the plurality of process cartridges 5, respectively.

The transfer unit 7 is disposed to face the lower sides of the plurality of process cartridges 5. The transfer unit 7 includes a driving roller 16, a driven roller 17, a conveyor belt 18, and a plurality of (four) transfer rollers 19 which is examples of a transfer member.

The driving roller 16 is rotatably supported at the rear end portion of the transfer unit 7.

The driven roller 17 is rotatably supported at the front end portion of the transfer unit 7.

The conveyor belt 18 is disposed around the driving roller 16 and the driven roller 17 such that the upper portion of the conveyor belt 18 be in contact with all photosensitive drums 11. Driving of the driving roller 16 and following of the driving roller 16 cause the conveyor belt 18 to circulate such that the upper portion of the conveyor belt 18 moves from the front side toward the rear side.

The plurality of transfer rollers 19 is disposed below the plurality of photosensitive drums 11 such that they face the photosensitive drums 11, respectively, with the upper portion of the conveyor belt 18 interposed therebetween.

The fixing unit 8 is disposed to face the rear side of the transfer unit 7. The fixing unit 8 includes a heating roller 20, and a pressing roller 21 that faces the heating roller 20.

Then, the toner contained in the developing cartridges 10 is triboelectrically and positively charged between the feeding rollers 14 and the developing rollers 13, and is carried, as thin layers having a constant thickness, on the development rollers 13 by the layer-thickness regulating blades 15.

Meanwhile, the surfaces of the photosensitive drums 11 are uniformly and positively charged by the scorotron chargers 12, and then are exposed based on predetermined image data by the LED units 6. As a result, on the surfaces of the photosensitive drums 11, electrostatic latent images based on the image data are formed. Then, the toner carried on the developing rollers 13 is fed to the electrostatic latent images formed on the surfaces of the photosensitive drums 11, whereby toner images (developer images) are carried on the surfaces of the photosensitive drums 11.

Paper sheets P which are examples of a recording medium are stored in a paper feeding tray 22 provided at the bottom of the main body casing 2, and are conveyed to make a U-turn toward the upper rear side by various rollers, and are fed one by one into the gaps between the photosensitive drums 11 and the conveyor belt 18 at predetermined timings. Then, each paper sheet is conveyed from the front side toward the rear side through the gaps between all the photosensitive drums 11 and all the transfer rollers 19 by the conveyor belt 18. At this time, if transfer biases (to be described below) are applied to the transfer rollers 19, the toner images are transferred onto a paper sheet P.

Then, when the paper sheet P passes through the gap between the heating roller 20 and the pressing roller 21, the paper sheet P is heated while being pressed. At this time, the toner image is thermally fixed on the paper sheet P.

Thereafter, the paper sheet P is conveyed to make a U-turn toward the upper front side, and is discharged to a paper discharge tray 23 provided at the top cover 4.

Figure 2:
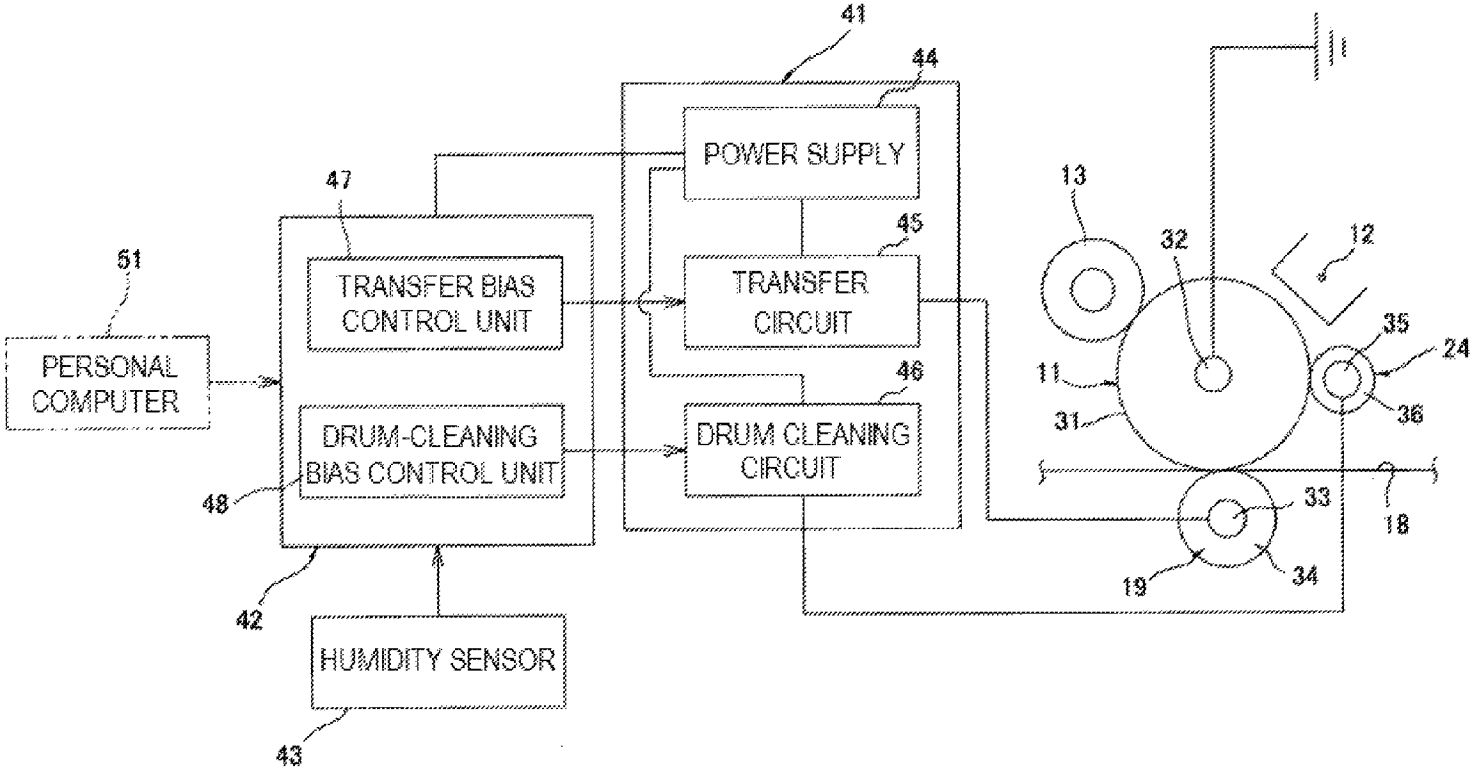
FIG. 2 is a block diagram illustrating a main portion of the electrical configuration of the printer shown in FIG. 1.

2. Details of Photosensitive Drums, Transfer Rollers, and Drum Cleaning Rollers (1) Photosensitive Drums As shown in FIG. 2, each photosensitive drum 11 includes a main drum body 31, and a shaft 32.

The main drum body 31 is made of a metal substantially in a cylindrical shape extending in the left-right direction. On the peripheral surface of the main drum body 31, a photosensitive layer is formed. In both end portions of the main drum body 31 in the left-right direction, brush members (not shown) are relatively rotatably fit, respectively.

The shaft 32 is made of a metal substantially in a columnar shape extending along the central axis of the main drum body 31. The shaft 32 is supported such that it passes through the radial centers of the brush members (not shown) and cannot rotate with respect to the brush members (not shown). The shaft 32 is electrically connected to the inner surface of the main drum body 31 through an electrically conductive member (not shown) made of a metal. Further, the shaft 32 is earthed (grounded) in the main body casing 2.

Then, each photosensitive drums 11 is rotated, counterclockwise as seen in a right side view, for example, at a peripheral speed of, for example, 165 mm/s.

(2) Transfer Rollers

Each transfer roller 19 includes a transfer roller shaft 33 and a main transfer roller body 34.

The transfer roller shaft 33 is made of a metal substantially in a columnar shape extending in the left-right direction.

The main transfer roller body 34 is made of an electrically conductive resin material and so on, substantially in a cylindrical shape extending in the left-right direction, such that the main transfer roller body covers the transfer roller shaft 33 so as to expose both end portions of the transfer roller shaft 33 in the left-right direction.

(3) Drum Cleaning Rollers

Each drum cleaning roller 24 includes a drum-cleaning-roller shaft 35 and a main drum-cleaning-roller body 36.

The drum-cleaning-roller shaft 35 is made of a metal substantially in a columnar shape extending in the left-right direction.

The drum-cleaning-roller body 36 is made of foam of silicon resin or urethane resin, or the like having semiconductivity. The main drum-cleaning-roller body 36 is formed substantially in a cylindrical shape extending in the left-right direction, such that the main drum-cleaning-roller body covers the drum-cleaning-roller shaft 35 so as to expose both end portions of the drum-cleaning-roller shaft 35 in the left-right direction.

Then, each drum cleaning roller 24 is rotated, clockwise as seen in a right side view, at a peripheral speed of, for example, 219 mm/s faster than the peripheral speed of the photosensitive drums 11. That is, the drum cleaning rollers 20 are rubbed against the photosensitive drums 11.

3. Electrical Configuration of Printer

Inside the main body casing 2, a power supply board 41, a humidity sensor 43, and a control device 42 are provided.

The power supply board 41 includes a power supply 44, a transfer circuit 45 for supplying electric power to the transfer rollers 19, and a drum cleaning circuit 46 for supplying electric power to the drum cleaning rollers 24.

The power supply 44 is electrically connected to the transfer circuit 45 and the drum cleaning circuit 46 through wiring lines.

The transfer circuit 45 is electrically connected to the transfer roller shafts 33 of the transfer rollers 19 through wiring lines. The transfer circuit 45 adjusts a voltage from the power supply board 41 to predetermined transfer biases based on control of the control device 42, and applies the predetermined transfer biases to the transfer roller shafts 33.

The drum cleaning circuit 46 is electrically connected to the drum-cleaning-roller shafts 35 of the drum cleaning rollers 24 through wiring lines. The drum cleaning circuit 46 adjusts a voltage from the power supply 44 to predetermined drum cleaning biases based on control of the control device 42, and applies the predetermined drum cleaning biases to the drum-cleaning-roller shafts 35.

The humidity sensor 43 is a sensor for measuring the relative humidity of the inside of the main body casing 2, and is electrically connected to the control device 42 through a signal line.

The control device 42 is configured by a CPU, a memory, and so on. The control device 42 is a component which is implemented in software by program processing of the CPU, and includes a transfer bias control unit 47 that is an example of a first control unit for controlling the transfer circuit 45, and a drum-cleaning-bias control unit 48 that is an example of a second control unit for controlling the drum cleaning circuit 46.

In the memory of the control device 42, a transfer bias table, a drum cleaning bias table and a program are stored. In the transfer bias table, set values for transfer currents are stored corresponding to relative humidity levels. In the drum cleaning bias table, set values for the drum cleaning biases are stored corresponding to relative humidity levels.

4. Image Forming Operation (1) Setting of Transfer Currents and Drum Cleaning Biases When the above described image forming operation is performed, first, the transfer biases are set in the transfer bias control unit 47, and at the same time, the drum cleaning biases are set in the drum-cleaning-bias control unit 48.

The transfer bias control unit 47 sets the transfer currents corresponding to the relative humidity of the inside of the main body casing 2 measured by the humidity sensor 43, with reference to the transfer bias table.

The drum-cleaning-bias control unit 48 sets the drum cleaning biases corresponding to the relative humidity of the inside of the main body casing 2 measured by the humidity sensor 43, with reference to the drum cleaning bias table.

(1-1) Case of Normal Humidity Environment

For example, in a case where the relative humidity of the inside of the main body casing 2 exceeds 30% and is less than 60%, the transfer bias control unit 47 and the drum-cleaning-bias control unit 48 determine that the electric resistance of a paper sheet P is comparatively low.

Then, the transfer bias control unit 47 sets a transfer current to flow between a photosensitive drum 11 and a transfer roller 19 corresponding to black, to, for example, −14 μA.

The transfer bias control unit 47 sets a transfer current to flow between a photosensitive drum 11 and a transfer roller 19 corresponding to yellow, to, for example, −11 μA.

Further, the transfer bias control unit 47 sets a transfer current to flow between a photosensitive drum 11 and a transfer roller 19 corresponding to magenta, to, for example, −13 μA.

Furthermore, the transfer bias control unit 47 sets a transfer current to flow between a photosensitive drum 11 and a transfer roller 19 corresponding to cyan, to, for example, −14 μA.

The drum-cleaning-bias control unit 48 sets the drum cleaning biases to be applied to all drum cleaning rollers 24 such that the potential differences from the surfaces of the photosensitive drums 11 become, for example, −300 V. That is, to the rearmost drum cleaning roller 24, a drum cleaning bias (a first cleaning bias) for making a potential difference from the surface of a corresponding photosensitive drum 11, for example, −300 V is applied.

(1-2) Case of Low Humidity Environment

For example, in a case where the relative humidity of the inside of the main body casing 2 is less than 30%, the transfer bias control unit 47 and the drum-cleaning-bias control unit 48 determine that the electric resistance of a paper sheet P is comparatively high.

Then, the transfer bias control unit 47 sets a transfer current to flow between a photosensitive drum 11 and a transfer roller 19 corresponding to black, to, for example, −15 μA.

The transfer bias control unit 47 sets a transfer current to flow between a photosensitive drum 11 and a transfer roller 19 corresponding to yellow, to, for example, −11 μA.

Further, the transfer bias control unit 47 sets a transfer current to flow between a photosensitive drum 11 and a transfer roller 19 corresponding to magenta, to, for example, −14 μA.

Furthermore, the transfer bias control unit 47 sets a transfer current to flow between a photosensitive drum 11 and a transfer roller 19 corresponding to cyan, to, for example, −15 μA.

That is, in a case of determining that the electric resistance of a paper sheet P is comparatively high, the transfer bias control unit 47 sets the transfer currents to flow between the photosensitive drums 11 and the transfer rollers 19, to transfer currents whose absolute values are larger than those in a case of determining that the electric resistance of a paper sheet P is comparatively low.

The drum-cleaning-bias control unit 48 controls the drum cleaning circuit 46, thereby setting the potential of a drum cleaning roller 24 corresponding to the rearmost photosensitive drum 11 (the photosensitive drum 11 of cyan) to a float potential, such that the potential difference between the rearmost drum cleaning roller 24 and the surface of the rearmost photosensitive drum 11 becomes 0 V. That is, to the rearmost drum cleaning roller 24, a drum cleaning bias (a second cleaning bias) equal to the potential of the surface of the rearmost photosensitive drum 11 is applied.

The drum-cleaning-bias control unit 48 sets the drum cleaning biases for drum cleaning rollers 24 corresponding to photosensitive drums other than the rearmost photosensitive drum 11 such that the potential differences from the surfaces of the corresponding photosensitive drums 11 become, for example, −300 V.

(2) Transferring and Cleaning Operations (2-1) Transferring and Cleaning Operations in Normal Humidity Environment When the above described image forming operation is performed, for example, if the relative humidity of the inside of the main body casing 2 exceeds 30% and is less than 60%, the transfer bias control unit 47 controls the transfer circuit 45, thereby applying transfer biases (first transfer biases) to the plurality of transfer rollers 19, respectively, such that the above described transfer currents constantly flow between the transfer rollers 19 and corresponding photosensitive drums 11 (constant current control).

The drum-cleaning-bias control unit 48 controls the drum cleaning circuit 46, thereby applying the above described drum cleaning biases to the plurality of drum cleaning rollers 24, respectively.

Then, when a paper sheet P passes through portions where the photosensitive drums 11 and the transfer rollers 19 face each other, toner images carried on the photosensitive drums 11 are transferred onto the paper sheet P.

At this time, on the peripheral surfaces of the photosensitive drums 11, toner which is an example of attached substances having not been transferred onto the paper sheet P (hereinafter, referred to as post-transfer residual toner) may remain.

Thereafter, rotating of the photosensitive drums 11 causes the post-transfer residual toner remaining on the peripheral surfaces of the photosensitive drums 11 to face corresponding drum cleaning rollers 24.

Then, the post-transfer residual toner is electrostatically held on the peripheral surfaces of the corresponding drum cleaning rollers 24 by the drum cleaning biases.

(2-2) Transferring and Cleaning Operations in Low Humidity Environment

When the above described image forming operation is performed, for example, if the relative humidity of the inside of the main body casing 2 is less than 30%, the transfer bias control unit 47 controls the transfer circuit 45, thereby applying transfer biases (second transfer biases) to the plurality of transfer rollers 19, respectively, such that the above described transfer currents constantly flow between the transfer rollers 19 and corresponding photosensitive drums 11 (constant current control).

The drum-cleaning-bias control unit 48 controls the drum cleaning circuit 46, thereby setting the drum cleaning bias for the drum cleaning roller 24 corresponding to the rearmost photosensitive drum 11 to the float potential, and applying the above described drum cleaning biases to the other drum cleaning rollers 24, respectively.

Further, the drum-cleaning-bias control unit 48 controls the drum cleaning circuit 46, thereby applying the above described drum cleaning biases to the plurality of drum cleaning rollers 24, respectively.

The drum-cleaning-bias control unit 48 controls the drum cleaning circuit 46, thereby changing the drum cleaning bias to be applied to the rearmost drum cleaning roller 24 to the float potential before a paper sheet P is fed between the rearmost photosensitive drum 11 and the rearmost transfer roller 19.

Then, when a paper sheet P passes through portions where the photosensitive drums 11 and the transfer rollers 19 face each other, toner images carried on the photosensitive drums 11 are transferred onto the paper sheet P.

Thereafter, rotating of the photosensitive drums 11 causes the post-transfer residual toner remaining on the peripheral surfaces of the photosensitive drums 11 to face corresponding drum cleaning rollers 24.

Then, the post-transfer residual toner remaining on the surface of the rearmost photosensitive drum 11 is scraped off the surface of the rearmost photosensitive drum 11 by rubbing a corresponding drum cleaning roller 24 against the surface of the rearmost photosensitive drum 11, and is held on the peripheral surface of the corresponding drum cleaning roller 24.

The post-transfer residual toner remaining on the peripheral surfaces of photosensitive drums 11 other than the rearmost photosensitive drum 11 is electrostatically held on the peripheral surfaces of corresponding drum cleaning rollers 24 by the drum cleaning biases.

4. Effects (1) According to the printer 1, in a case where it is expected that the relative humidity of the inside of the main body casing 2 is low and the electric resistance of a paper sheet P is comparatively high, the transfer bias control unit 47 increases the set values for the transfer currents.

Then, in the portions where the photosensitive drums 11 and the transfer rollers 19 face each other, the transfer currents excessively act on the toner, whereby the charged state of the toner becomes likely to vary.

Especially, in a tandem type direct color printer like the printer 1, a transfer current to flow between a photosensitive drum 11 and a transfer roller 19 located on a more downstream side (more rear side) in the conveyance direction of a paper sheet P (a direction from the front side toward the rear side) is set to be larger than a transfer current to flow between a photosensitive drum 11 and a transfer roller 19 located on a more upstream side (more front side).

For this reason, in a portion where the rearmost photosensitive drum 11 and the rearmost transfer roller 19 face each other, the charged state of the toner becomes likely to vary.

Therefore, the drum-cleaning-bias control unit 48 sets a drum cleaning bias for a drum cleaning roller 24 corresponding to the rearmost photosensitive drum 11 to the float potential such that the potential difference between the surface of the rearmost photosensitive drum 11 and the rearmost drum cleaning roller 24 becomes substantially 0 V.

Therefore, even if the charged state of post-transfer residual toner attached to the rearmost photosensitive drum 11 varies, it is possible to physically scrape the post-transfer residual toner off the rearmost photosensitive drum 11 by rubbing the rearmost drum cleaning roller 24 against the rearmost photosensitive drum 11.

As a result, it is possible to reliably remove the post-transfer residual toner attached to the photosensitive drums 11 by the drum cleaning rollers 24.

(2) According to the printer 1, the transfer bias control unit 47 controls the transfer biases such that the transfer currents become constant.

For this reason, it is possible to prevent the transfer currents from varying due to a change in the electric resistance of a paper sheet P.

As a result, it is possible to reliably transfer toner images on the surfaces of the photosensitive drums 11 onto a paper sheet P.

(3) According to the printer 1, in a case where the relative humidity measured by the humidity sensor 43 is less than 30%, the drum-cleaning-bias control unit 48 determines that the electric resistance of a paper sheet P is comparatively high.

For this reason, it is possible to smoothly reduce the potential differences between the surfaces of the photosensitive drums 11 and the drum cleaning rollers 24 by predicting the electric resistance of a paper sheet P from the relative humidity measured by the humidity sensor 43.

In a case where the relative humidity is 30% or less, and thus the charged state of toner is likely to vary, it is possible to effectively clean post-transfer residual toner off the photosensitive drums 11.

(4) According to the printer 1, the drum-cleaning-bias control unit 48 sets the drum cleaning bias for the rearmost drum cleaning roller 24 to the float potential before a paper sheet P is fed between the rearmost photosensitive drum 11 and the rearmost transfer roller 19.

For this reason, it is possible to reliably set the drum cleaning bias for the rearmost drum cleaning roller 24 to the float potential before the rearmost drum cleaning roller 24 acts on post-transfer residual toner.

Therefore, it is possible to more reliably remove post-transfer residual toner attached to the surface of the rearmost photosensitive drum 11.

(5) According to the printer 1, the cleaning bias for the rearmost drum cleaning roller 24 is set to the float potential such that the potential difference between the surface of the rearmost photosensitive drum 11 and the rearmost drum cleaning roller 24 becomes 0 V.

For this reason, it is possible to reliably reduce the potential difference between the surface of the rearmost photosensitive drum 11 and the rearmost drum cleaning roller 24 by a simple configuration.

As a result, it is possible to more reliably remove post-transfer residual toner attached to the surface of the rearmost photosensitive drum 11.

(6) According to the printer 1, the drum-cleaning-bias control unit 48 controls only the drum cleaning bias to be applied to a drum cleaning roller 24 corresponding to the rearmost photosensitive drum 11.

For this reason, it is possible to reliably remove post-transfer residual toner from the rearmost photosensitive drum 11 to which post-transfer residual toner whose charged state having changed is especially likely to attach.

5. Second Embodiment

A second embodiment of the printer 1 will be described with reference to FIG. 2. In the second embodiment, members identical to those of the above described first embodiment are denoted by the same reference symbols, and will not be described.

(1) Outline of Second Embodiment

In the above described first embodiment, for example, in a case where the relative humidity of the inside of the main body casing 2 is 30% or less, the transfer bias control unit 47 and the drum-cleaning-bias control unit 48 determine that the electric resistance of a paper sheet P is comparatively high.

In contrast, in the second embodiment, in a case where a print job has been input from an external personal computer 51 or the like to the printer 1 as shown by a virtual line in FIG. 2, if the length of a paper sheet P in the left-right direction designated in the print job is in a predetermined ratio or less with respect to the length of a maximum image forming area of a photosensitive drum in the left-right direction, the transfer bias control unit 47 and the drum-cleaning-bias control unit 48 determine that the electric resistance of the paper sheet P is comparatively high.

(2) Setting of Transfer Currents and Drum Cleaning Biases

In the second embodiment, in a case where the length of a paper sheet P in the left-right direction is, for example, in 80% or less, preferably, 60% or less, with reference to the length of the maximum image forming area of a photosensitive drum, the transfer bias control unit 47 and the drum-cleaning-bias control unit 48 determine that the electric resistance of the paper sheet P is comparatively high.

Then, likely in the above described first embodiment, the transfer bias control unit 47 sets a transfer current to flow between each of the plurality of photosensitive drums 11 and a corresponding transfer roller 19.

The drum-cleaning-bias control unit 48 sets the drum cleaning biases to be applied to the plurality of drum cleaning rollers 24, respectively.

(3) Effects of Second Embodiment

Even in the second embodiment, it is possible to achieve the same effects as those of the above described first embodiment.

Specifically, in the second embodiment, in a case where the size of a paper sheet P (the length in the left-right direction) is in the above described ratio or less with respect to the length of the maximum image forming area of a photosensitive drum, the transfer bias control unit 47 determines that the electric resistance of the paper sheet P is comparatively high and sets the transfer currents to flow between the photosensitive drums 11 and the transfer rollers 19 to be large likely in the first embodiment, such that sufficient transfer currents flow in the paper sheet P having a comparatively small size.

Even in this case, likely in the above described first embodiment, the drum-cleaning-bias control unit 48 sets a drum cleaning bias for a drum cleaning roller 24 corresponding to the rearmost photosensitive drum 11 to the float potential such that the potential difference between the surface of the rearmost photosensitive drum 11 and the rearmost drum cleaning roller 24 becomes substantially 0 V.

For this reason, it is possible to reliably remove the post-transfer residual toner attached to the photosensitive drums 11 by the drum cleaning rollers 24.

6. Third Embodiment

A third embodiment of the printer 1 will be described with reference to FIG. 3. In the third embodiment, members identical to those of the above described first embodiment are denoted by the same reference symbols, and will not be described.

(1) Outline of Third Embodiment

In the above described first embodiment, the relative humidity of the inside of the main body casing 2 is detected by the humidity sensor 43, and the electric resistance of a paper sheet P is determined based on the detected relative humidity.

In contrast, in the third embodiment, the electric resistance between the transfer rollers 19 and the photosensitive drums 11 is measured, and the electric resistance of a paper sheet P is determined based on the measured electric resistance.

(2) Configuration of Third Embodiment

Figure 3:
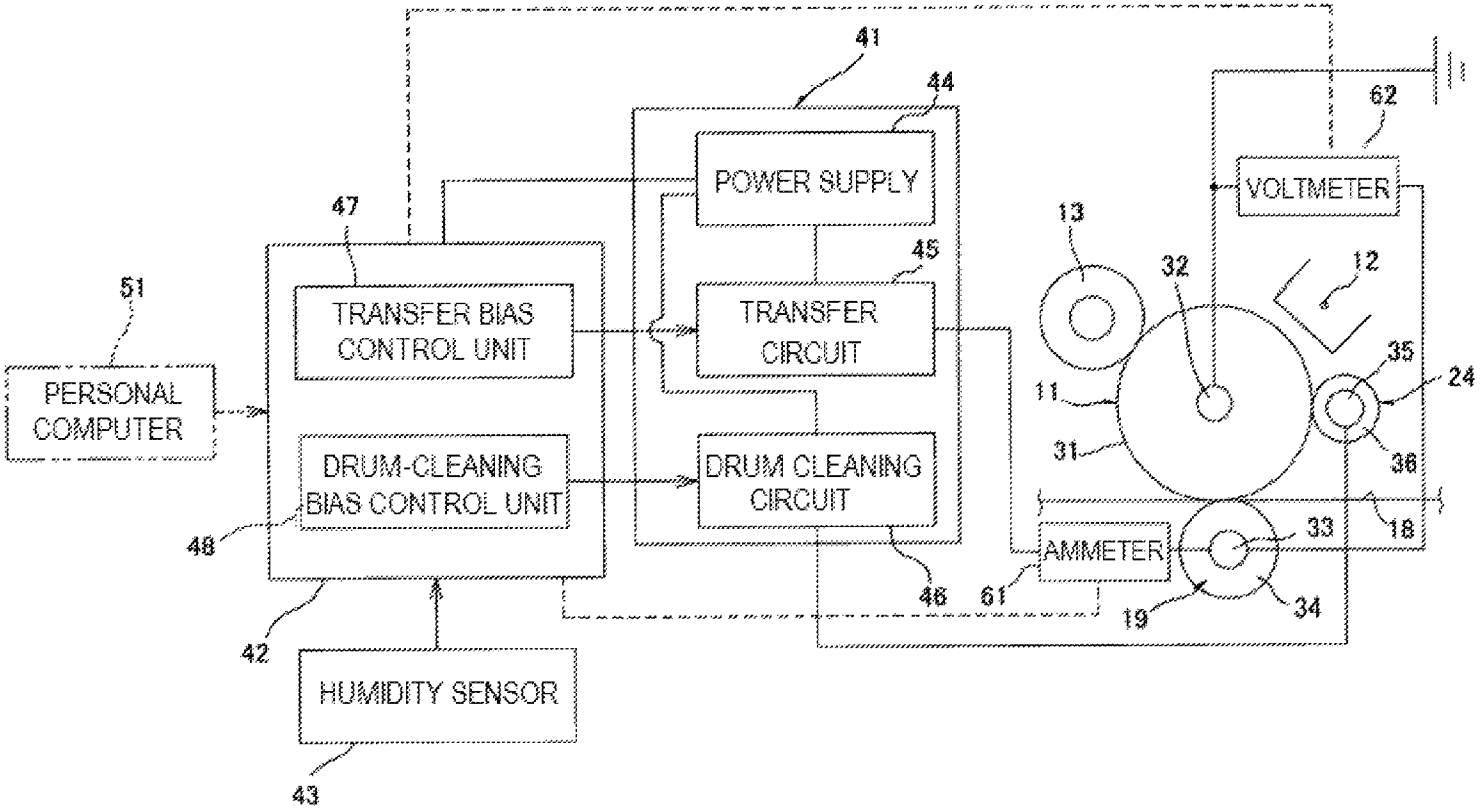
FIG. 3 is a block diagram illustrating a main portion of the electrical configuration of a printer of a third embodiment.

In the third embodiment, as shown in FIG. 3, ammeters 61 and voltmeters 62 that are examples of a detecting means are provided.

The ammeters 61 are interposed between the transfer circuit 45 and the transfer roller shafts 33. The ammeters 61 measure the current values of currents flowing from the transfer circuit 45 to the transfer roller shafts 33. The ammeters 61 are electrically connected to the control device 42 through signal lines (shown by a broken line in FIG. 3). The ammeters 61 transmit the measured current values to the control device 42.

The voltmeters 62 are electrically connected to the transfer roller shafts 33 and the shafts 32. The voltmeters 62 measure voltages applied between the transfer roller shafts 33 and the shafts 32. The voltmeters 62 are electrically connected to the control device 42 through signal lines (shown by a broken line in FIG. 3). The voltmeters 62 transmit the measured voltages to the control device 42.

Then, the control device 42 computes the electric resistance between the transfer rollers 19 and the photosensitive drums 11 based on the current values measured by the ammeters 61 and the voltages measured by the voltmeters 62.

(3) Setting of Transfer Currents and Drum Cleaning Biases

In the third embodiment, for example, in a case where the electric resistance between the transfer rollers 19 and the photosensitive drums 11 is equal to $1.0\times10^{12}\Omega$ or more, the transfer bias control unit 47 determines that the electric resistance of a paper sheet P is comparatively high.

Then, likely in the above described first embodiment, the transfer bias control unit 47 sets a transfer current to flow between each of the plurality of photosensitive drums 11 and a corresponding transfer roller 19.

The transfer bias control unit 47 controls the transfer circuit 45, thereby applying transfer biases (second transfer biases) to the plurality of transfer rollers 19, respectively, such that the above described transfer currents constantly flow between the transfer rollers 19 and corresponding photosensitive drums 11 (constant current control). The applied transfer biases are measured by the voltmeters 62.

Then, in a case where the transfer biases measured by the voltmeters 62 are equal to the second transfer biases or more, the drum-cleaning-bias control unit 48 determines that the electric resistance of a paper sheet P is comparatively high.

Then, likely in the above described first embodiment, the drum-cleaning-bias control unit 48 sets the drum cleaning biases to be applied to the plurality of drum cleaning rollers 24, respectively.

Thereafter, the drum-cleaning-bias control unit 48 controls the drum cleaning circuit 46, thereby changing the drum cleaning bias to be applied to the rearmost drum cleaning roller 24 to the float potential after the paper sheet P is fed between the rearmost photosensitive drum 11 and the rearmost transfer roller 19 until the post-transfer residual toner faces the rearmost drum cleaning roller 24.

(4) Effects of Third Embodiment (4-1) According to the printer 1 of the third embodiment, in a case where the transfer biases measured by the voltmeters 62 are equal to the second transfer biases or more, the drum-cleaning-bias control unit 48 determines that the electric resistance of a paper sheet P is comparatively high.

For this reason, it is possible to more effectively reduce the potential difference between the surface of the rearmost photosensitive drum 11 and the rearmost drum cleaning roller 24 by measuring the transfer biases.

(4-2) According to the printer 1 of the third embodiment, the drum-cleaning-bias control unit 48 changes the drum cleaning bias to be applied to the rearmost drum cleaning roller 24 to the float potential after a paper sheet P is fed between the rearmost photosensitive drum 11 and the rearmost transfer roller 19 until post-transfer residual toner faces the rearmost drum cleaning roller 24.

For this reason, it is possible to more reliably remove post-transfer residual toner attached to the surface of the rearmost photosensitive drum 11.

(4-3) Even in the third embodiment, it is possible to achieve the same effects as those of the above described first embodiment.

7. Fourth Embodiment

A fourth embodiment of the printer 1 will be described with reference to FIG. 3. In the fourth embodiment, members identical to those of the above described third embodiment are denoted by the same reference symbols, and will not be described.

(1) Outline of Fourth Embodiment

In the above described third embodiment, in the transfer bias table, set values for the transfer currents are stored corresponding to relative humidity levels. Then, the transfer bias control unit 47 controls the transfer circuit 45, thereby applying transfer biases to the plurality of transfer rollers 19, respectively, such that the transfer currents set based on the transfer bias table flow (constant current control).

In contrast, in the fourth embodiment, in a transfer bias table, set values for the transfer biases are stored corresponding to relative humidity levels. Then, the transfer bias control unit 47 controls the transfer circuit 45, thereby applying transfer biases set based on the transfer bias table to the plurality of transfer rollers 19, respectively (constant voltage control).

(2) Setting of Transfer Currents and Drum Cleaning Biases (2-1) Case of Normal Humidity Environment In the fourth embodiment, if the electric resistance between the transfer rollers 19 and the photosensitive drums 11 is, for example, $1.0\times10^{11}\Omega$ or less, the transfer bias control unit 47 determines that the electric resistance of a paper sheet P is comparatively low.

Then, the transfer bias control unit 47 sets a transfer bias (the first transfer bias) to be applied to a transfer roller 19 corresponding to black to, for example, −3500 V.

The transfer bias control unit 47 sets a transfer bias (the first transfer bias) to be applied to a transfer roller 19 corresponding to yellow to, for example, −3500 V.

Further, the transfer bias control unit 47 sets a transfer bias (the first transfer bias) to be applied to a transfer roller 19 corresponding to magenta to, for example, −3500 V.

Furthermore, the transfer bias control unit 47 sets a transfer bias (the first transfer bias) to be applied to a transfer roller 19 corresponding to cyan to, for example, −3500 V.

Like in the above described first embodiment, the drum-cleaning-bias control unit 48 sets the drum cleaning biases to be applied to the plurality of drum cleaning rollers 24, respectively.

Then, the transfer bias control unit 47 controls the transfer circuit 45, thereby applying the above described transfer biases to the plurality of transfer rollers 19, respectively (constant voltage control). The applied transfer biases are measured by the voltmeters 62.

Then, since the transfer biases measured by the voltmeters 62 are the first transfer biases, the drum-cleaning-bias control unit 48 determines that the electric resistance of a paper sheet P is comparatively low.

Then, likely in the above described first embodiment, the drum-cleaning-bias control unit 48 sets the drum cleaning biases to be applied to the plurality of drum cleaning rollers 24, respectively.

Then, the drum-cleaning-bias control unit 48 controls the drum cleaning circuit 46, thereby applying the above described drum cleaning biases to the plurality of drum cleaning rollers 24, respectively.

(2-2) Case of Low Humidity Environment

If the electric resistance between the transfer rollers 19 and the photosensitive drums 11 is, for example, $1.0\times10^{12}\Omega$ or less, the transfer bias control unit 47 determines that the electric resistance of a paper sheet P is comparatively high.

Then, the transfer bias control unit 47 sets a transfer bias (the second transfer bias) to be applied to a transfer roller 19 corresponding to black to, for example, −5000 V.

The transfer bias control unit 47 sets a transfer bias (the second transfer bias) to be applied to a transfer roller 19 corresponding to yellow to, for example, −4500 V.

Further, the transfer bias control unit 47 sets a transfer bias (the second transfer bias) to be applied to a transfer roller 19 corresponding to magenta to, for example, −5000 V.

Furthermore, the transfer bias control unit 47 sets a transfer bias (the second transfer bias) to be applied to a transfer roller 19 corresponding to cyan to, for example, −5000 V.

That is, in a case of determining that the electric resistance of a paper sheet P is comparatively high, the transfer bias control unit 47 sets the transfer biases to be applied to the transfer rollers 19 to transfer biases having absolute values larger than those in a case of determining that the electric resistance of a paper sheet P is comparatively low.

Further, the transfer bias control unit 47 controls the transfer circuit 45, thereby applying the above described transfer biases to the plurality of transfer rollers 19, respectively (constant voltage control). The applied transfer biases are measured by the voltmeters 62.

Then, in a case where the transfer biases measured by the voltmeters 62 are equal to the second transfer biases or more, the drum-cleaning-bias control unit 48 determines that the electric resistance of a paper sheet P is comparatively high.

Then, likely in the above described first embodiment, the drum-cleaning-bias control unit 48 sets the drum cleaning biases to be applied to the plurality of drum cleaning rollers 24, respectively.

Thereafter, the drum-cleaning-bias control unit 48 controls the drum cleaning circuit 46, thereby changing the drum cleaning bias to be applied to the rearmost drum cleaning roller 24 to the float potential after the paper sheet P is fed between the rearmost photosensitive drum 11 and the rearmost transfer roller 19 until the post-transfer residual toner faces the rearmost drum cleaning roller 24.

(3) Effects of Fourth Embodiment

According to the fourth embodiment, the transfer bias control unit 47 performs control such that the transfer biases are constant. Further, in a case where the transfer biases measured by the voltmeters 62 have been switched to the second transfer biases, the drum-cleaning-bias control unit 48 determines that the electric resistance of a paper sheet P is comparatively high.

For this reason, in a configuration in which transfer biases are applied to the transfer rollers 19 by constant voltage control, it is possible to reliably remove post-transfer residual toner attached to the photosensitive drums 11 by the drum cleaning rollers 24.

It is possible to more effectively reduce the potential difference between the surface of the rearmost photosensitive drum 11 and the rearmost drum cleaning roller 24 by measuring the transfer biases.

Even in the fourth embodiment, it is possible to achieve the same effects as those of the above described third embodiment.

8. Fifth Embodiment

A fifth embodiment of the printer 1 will be described with reference to FIG. 4. In the fifth embodiment, members identical to those of the above described first embodiment are denoted by the same reference symbols, and will not be described.

(1) Outline of Fifth Embodiment

In the above described first embodiment, the printer 1 has been configured as a color printer.

Figure 4:
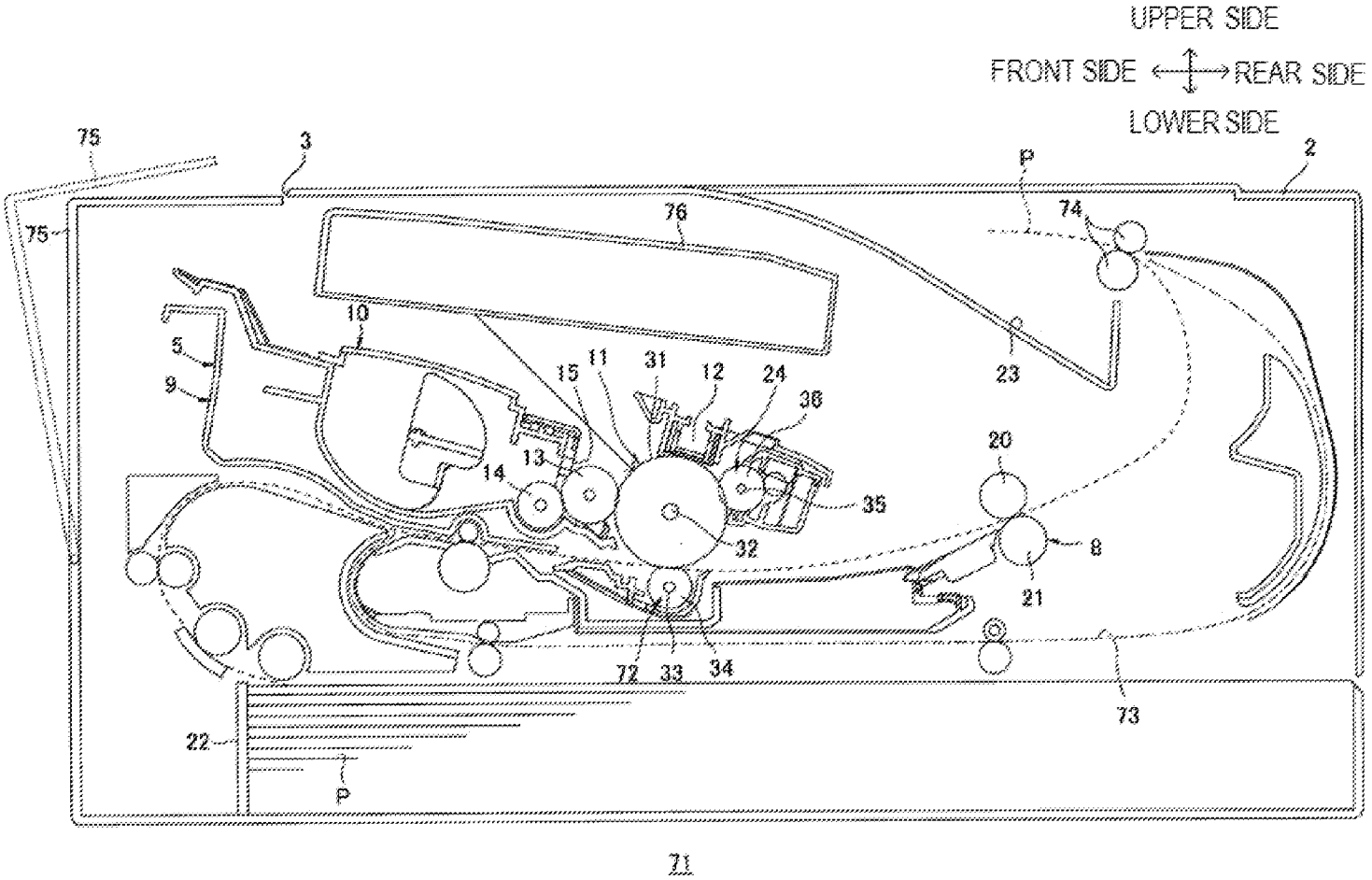
FIG. 4 is a sectional side view illustrating a printer of a fifth embodiment.

In contrast, in the fifth embodiment, as shown in FIG. 4, a printer 71 is configured as a monochrome printer.

(2) Configuration of Fifth Embodiment

The printer 71 of the fifth embodiment does not have process cartridges 5 of yellow, magenta, and cyan but has a process cartridge 5 of black.

The printer 71 of the fifth embodiment has a transfer roller 72 as an example of a transfer member, instead of the transfer unit 7.

The transfer roller 72 is rotatably supported at the rear end portion of the process cartridge 5 below a photosensitive drum 11. The transfer roller 72 comes into contact with the photosensitive drum 11 from the lower side.

The printer 71 of the fifth embodiment includes a reverse path 73 as an example of a conveying means for conveying a paper sheet P having a toner image fixed thereon, from a fixing unit 8 to the gap between the photosensitive drum 11 and the transfer roller 72 as shown by a virtual line in FIG. 4.

The reverse path 73 is provided to extend the rear side of the fixing unit 8 in a vertical direction and extend the upper side of a paper feeding tray 22 and the lower sides of the fixing unit 8 and the process cartridge 5 in the front-rear direction. The front end portion of the reverse path 73 is on the substantially central portion of the process cartridge 5 in the front-rear direction. The rear end portion of the reverse path 73 is disposed to face the lower rear sides of paper discharging rollers 74 for discharging paper sheets P.

A paper sheet P having a toner image fixed thereon is introduced into the reverse path 73 by rotating of the paper discharging rollers 74 such that a surface (a first surface) having the toner image fixed thereon is directed downward.

Thereafter, the paper sheet P passes through the reverse path 73 from the rear side to the front side, and is fed to the gap between the photosensitive drum 11 and the transfer roller 72 such that a surface (a second surface) opposite to the surface (the first surface) having the toner image fixed thereon is directed upward.

In the printer 71 of the fifth embodiment, a main body opening 3 is formed at the front end portion of a main body casing 2, and at the front end portion of the main body casing 2, a front cover 75 for opening and closing the main body opening 3 is provided to be able to swing on a lower end portion of the front cover.

In the printer 71 of the fifth embodiment, the photosensitive drum 11 is exposed by a scanner unit 76. The scanner unit 76 is disposed to face the upper side of the process cartridge 5. The scanner unit 76 emits a laser beam toward the photosensitive drum 11 as shown by a solid line, based on image data.

(3) Setting of Transfer Current and Drum Cleaning Bias

In the fifth embodiment, when a print job has been input from an external personal computer 51 or the like to the printer 71, in a case where duplex printing has been designated in the print job (that is, a case of consecutively printing both surfaces (a first surface and a second surface) of a paper sheet P), the transfer bias control unit 47 and the drum-cleaning-bias control unit 48 determine that the electric resistance of a paper sheet P is comparatively high.

Then, likely in the above described first embodiment, the transfer bias control unit 47 sets a transfer current to flow between the photosensitive drum 11 and the transfer roller 72.

The drum-cleaning-bias control unit 48 sets a drum cleaning bias to be applied to the drum cleaning roller 24.

(4) Effects of Fifth Embodiment

In the printer 71 of the fifth embodiment, when a paper sheet P passes through a fixing unit 8, the paper sheet P is heated to be dried, and the electric resistance of the paper sheet P increases. Even in this case, it is possible to reliably remove post-transfer residual toner attached to the photosensitive drum 11 by the drum cleaning roller 24.

9. Modifications

The above described embodiments can be combined with each other.

For example, as shown in FIG. 2, the first embodiment and the second embodiment can be combined.

In this case, as described above, the control device 42 sets the transfer currents and the drum cleaning biases based on designation of a paper size in a print job and detection of the relative humidity by the humidity sensor 43.

As shown in FIG. 3, the second embodiment and the third embodiment can be combined.

In this case, as described above, the control device 42 sets the transfer currents and the drum cleaning biases based on designation of a paper size in a print job and detection of the relative humidity by the humidity sensor 43.

In the fifth embodiment, like in the above described first embodiment, it is possible to set the transfer current and the drum cleaning bias based on detection of the relative humidity by the humidity sensor 43.

In the fifth embodiment, it is possible to apply at least one of the above described second embodiment, third embodiment, and fourth embodiment.

In the above embodiment, the control device 42 including the CPU and the memory carries out the cleaning bias control. However, the invention is not limited to this. For example, the control device 42 may be configured by a device including a plurality of CPU and memories for carrying out the cleaning bias control, configured only by a hardware circuit such as ASIC (Application Specific Integrated Circuit), or configured by a combination of a CPU and a hardware circuit such as ASIC.

What is claimed is:

1. An image forming apparatus comprising:

an image carrier configured to carry a developer image;

a transfer member configured to face the image carrier and transfer the developer image from the image carrier onto a recording medium;

a cleaning member configured to rub against the image carrier, and clean the image carrier of substances after the developer image is transferred onto the recording medium;

a control device configured to:

determine whether the electric resistance of the recording medium is comparatively low or high;

apply a first transfer bias to the transfer member when it is determined that the electric resistance of the recording medium is comparatively low;

apply a second transfer bias having the same polarity as that of the first transfer bias and having an absolute value larger than that of the first transfer bias, to the transfer member when it is determined that the electric resistance of the recording medium is comparatively high;

apply a first cleaning bias to the cleaning member when it is determined that the electric resistance of the recording medium is comparatively low; and apply a second cleaning bias to the cleaning member when it is determined that the electric resistance of the recording medium is comparatively high, wherein a first potential difference between a portion of a surface of the image carrier against which the cleaning member rubs and the cleaning member to which the second cleaning bias is applied is smaller than an absolute value of a second potential difference between the portion of the surface of the image carrier against which the cleaning member rubs and the cleaning member to which the first cleaning bias is applied, and wherein an absolute value of the second cleaning bias is smaller than an absolute value of the first cleaning bias.

2. The image forming apparatus according to claim 1, wherein the control device is further configured to control a transfer bias of the transfer member such that a transfer current flowing between the image carrier and the transfer member becomes constant.

3. The image forming apparatus according to claim 2, further comprising:

a humidity sensor configured to measure relative humidity, wherein the control device is further configured to determine that the electric resistance of the recording medium is comparatively high if the relative humidity measured by the humidity sensor is equal to or less than a predetermined relative humidity.

4. The image forming apparatus according to claim 3, wherein the control device is further configured to determine that the electric resistance of the recording medium is comparatively high if the relative humidity measured by the humidity sensor is 30% or less.

5. The image forming apparatus according to claim 3, wherein the control device is further configured to apply the second cleaning bias to the cleaning member before the recording medium is fed between the image carrier and the transfer member if it is determined that the electric resistance of the recording medium is comparatively high.

6. The image forming apparatus according to claim 2, wherein the control device is further configured to determine that the electric resistance of the recording medium is comparatively high if the length of the recording medium in a longitudinal direction of the image carrier is in a predetermined ratio or less with respect to a maximum image forming area of the image carrier.

7. The image forming apparatus according to claim 2, further comprising:

a fixing device configured to heat the recording medium having the developer image transferred on a first surface to fix the developer image on the first surface; and a conveying unit configured to convey the recording medium having the developer image fixed on the first surface, from the fixing device to a gap between the image carrier and the transfer member, wherein the control device is further configured to determine that the electric resistance of the recording medium is comparatively high if a developer image is to be transferred onto a second surface opposite to the first surface of the recording medium conveyed by the conveying unit.

8. The image forming apparatus according to claim 2 further comprising:

a detector configured to detect a transfer bias, wherein the control device is configured to determine that the electric resistance of the recording medium is comparatively high by determining that the transfer bias detected by the detector is equal to or greater than the second transfer bias.

9. The image forming apparatus according to claim 8, wherein the control device is further configured to apply the second cleaning bias to the cleaning member after the recording medium is fed between the image carrier and the transfer member until attached substances face the cleaning member if it is determined that the electric resistance of the recording medium is comparatively high.

10. The image forming apparatus according to claim 1 further comprising:

a detector configured to detect a transfer bias, wherein the control device is further configured to perform control such that the transfer bias becomes constant, and wherein the control device is further configured to determine that the electric resistance of the recording medium is comparatively high if the transfer bias detected by the detector is switched to the second transfer bias.

11. The image forming apparatus according to claim 1, wherein when the second cleaning bias is applied to the cleaning member, the first potential difference between the portion of the surface of the image carrier against which the cleaning member rubs against and the cleaning member is 0.

12. An image forming apparatus comprising:

an image carrier configured to carry a developer image;

a transfer member configured to face the image carrier and transfer the developer image from the image carrier onto a recording medium;

a cleaning member configured to rub against the image carrier, and clean the image carrier of substances after the developer image is transferred onto the recording medium; and a control device configured to:

determine whether the electric resistance of the recording medium is comparatively low or high;

apply a first transfer bias to the transfer member when it is determined that the electric resistance of the recording medium is comparatively low;

apply a second transfer bias having the same polarity as that of the first transfer bias and having an absolute value larger than that of the first transfer bias, to the transfer member when it is determined that the electric resistance of the recording medium is comparatively high;

apply a first cleaning bias to the cleaning member when it is determined that the electric resistance of the recording medium is comparatively low; and apply a second cleaning bias to the cleaning member so that a potential difference between a portion of a surface of the image carrier against which the cleaning member rubs and the cleaning member becomes smaller than that in a case of applying the first cleaning bias to the cleaning member when it is determined that the electric resistance of the recording medium is comparatively high, wherein:

a plurality of image carriers are disposed in parallel at intervals along a conveyance direction of the recording medium, a plurality of transfer members are provided corresponding to the plurality of image carriers, respectively, a plurality of cleaning members are provided corresponding to the plurality of image carriers, respectively, and the control device is further configured to control only a cleaning bias to be applied to the cleaning member corresponding to the image carrier located on a most downstream side in the conveyance direction.

13. The image forming apparatus according to claim 12, wherein the control device is further configured to control a transfer bias of the transfer member such that a transfer current flowing between the image carrier and the transfer member becomes constant.

14. The image forming apparatus according to claim 13, further comprising:

a humidity sensor configured to measure relative humidity, wherein the control device is further configured to determine that the electric resistance of the recording medium is comparatively high if the relative humidity measured by the humidity sensor is equal to or less than a predetermined relative humidity.

15. The image forming apparatus according to claim 14, wherein the control device is further configured to determine that the electric resistance of the recording medium is comparatively high if the relative humidity measured by the humidity sensor is 30% or less.

16. The image forming apparatus according to claim 14, wherein the control device is further configured to apply the second cleaning bias to the cleaning member before the recording medium is fed between the image carrier and the transfer member if it is determined that the electric resistance of the recording medium is comparatively high.

17. The image forming apparatus according to claim 13, wherein the control device is further configured to determine that the electric resistance of the recording medium is comparatively high if a length of the recording medium in a longitudinal direction of the image carrier is in a predetermined ratio or less with respect to a maximum image forming area of the image carrier.

18. The image forming apparatus according to claim 13, further comprising:

a fixing device configured to heat the recording medium having the developer image transferred on a first surface to fix the developer image on the first surface; and a conveying unit configured to convey the recording medium having the developer image fixed on the first surface, from the fixing device to a gap between the image carrier and the transfer member, wherein the control device is further configured to determine that the electric resistance of the recording medium is comparatively high if a developer image is to be transferred onto a second surface opposite to the first surface of the recording medium conveyed by the conveying unit.

19. The image forming apparatus according to claim 13, further comprising:

a detector configured to detect a transfer bias, wherein the control device is configured to determine that the electric resistance of the recording medium is comparatively high by determining that the transfer bias detected by the detector is equal to or greater than the second transfer bias.

20. The image forming apparatus according to claim 19, wherein the control device is further configured to apply the second cleaning bias to the cleaning member after the recording medium is fed between the image carrier and the transfer member until attached substances face the cleaning member if it is determined that the electric resistance of the recording medium is comparatively high.

21. The image forming apparatus according to claim 12, further comprising:

a detector configured to detect a transfer bias, wherein the control device is further configured to perform control such that the transfer bias becomes constant, and wherein the control device is further configured to determine that the electric resistance of the recording medium is comparatively high if the transfer bias detected by the detector is switched to the second transfer bias.

22. The image forming apparatus according to claim 12, wherein when the second cleaning bias is applied to the cleaning member, the potential difference between the portion of the surface of the image carrier against which the cleaning member rubs against and the cleaning member is 0.

23. An image forming apparatus comprising:

an image carrier configured to carry a developer image;

a transfer member configured to face the image carrier and transfer the developer image from the image carrier onto a recording medium;

a cleaning member configured to be rubbed against the image carrier, and clean substances attached to the image carrier after the developer image is transferred onto the recording medium;

a humidity sensor configured to measure relative humidity;

a control device configured to:

apply a first transfer bias to the transfer member when the relative humidity measured by the humidity sensor is higher than a predetermined relative humidity;

apply a second transfer bias having the same polarity as that of the first transfer bias and having an absolute value larger than that of the first transfer bias, to the transfer member when the relative humidity measured by the humidity sensor is equal to the predetermined relative humidity or less;

apply a first cleaning bias to the cleaning member when the relative humidity measured by the humidity sensor is higher than the predetermined relative humidity; and apply a second cleaning bias to the cleaning member when the relative humidity measured by the humidity sensor is equal to the predetermined relative humidity or less, wherein a first potential difference between a portion of a surface of the image carrier against which the cleaning member rubs and the cleaning member to which the second cleaning bias is applied is smaller than an absolute value of a second potential difference between the portion of the surface of the image carrier against which the cleaning member rubs and the cleaning member to which the first cleaning bias is applied, wherein an absolute value of the second cleaning bias is smaller than an absolute value of the first cleaning bias.

* * * * *